US008911041B2

(12) United States Patent
Kwon et al.

(10) Patent No.: US 8,911,041 B2
(45) Date of Patent: Dec. 16, 2014

(54) WATER-FILTER MOUNTING STRUCTURE FOR REFRIGERATOR

(75) Inventors: Oh-Chul Kwon, Gimhae (KR); Jun-Heon Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 909 days.

(21) Appl. No.: 12/065,467

(22) PCT Filed: Sep. 4, 2006

(86) PCT No.: PCT/KR2006/003498

§ 371 (c)(1),
(2), (4) Date: Feb. 29, 2008

(87) PCT Pub. No.: WO2007/027071

PCT Pub. Date: Mar. 8, 2007

(65) Prior Publication Data

US 2008/0258597 A1 Oct. 23, 2008

(30) Foreign Application Priority Data

Sep. 2, 2005 (KR) ..... 10-2005-0081730
Sep. 20, 2005 (KR) ..... 10-2005-0087446

(51) Int. Cl.
*F25D 19/00* (2006.01)
*F25D 23/12* (2006.01)
*F25D 23/02* (2006.01)

(52) U.S. Cl.
CPC ..... *F25D 23/126* (2013.01); *F25D 2323/121* (2013.01); *F25D 23/02* (2013.01)
USPC ... 312/405.1; 210/232; 210/235; 222/189.06; 62/449

(58) Field of Classification Search
USPC ..... 210/232, 235; 62/338, 337, 339, 449; 312/404, 405.1; 222/189.06
See application file for complete search history.

(56) References Cited

U.S. PATENT DOCUMENTS

| | | | | |
|---|---|---|---|---|
| 5,184,476 | A * | 2/1993 | Desrosiers et al. | 62/389 |
| 5,616,243 | A * | 4/1997 | Levy | 210/282 |
| 5,813,246 | A | 9/1998 | Oh | |
| 5,907,958 | A | 6/1999 | Coates et al. | |
| 6,337,015 | B1 * | 1/2002 | Poirier | 210/232 |
| 6,574,984 | B1 | 6/2003 | McCrea et al. | |
| 6,800,199 | B1 * | 10/2004 | Rhee | 210/232 |
| 2001/0023843 | A1 * | 9/2001 | Senner et al. | 210/232 |
| 2004/0211717 | A1 * | 10/2004 | Mitchell et al. | 210/235 |

FOREIGN PATENT DOCUMENTS

| | | | | |
|---|---|---|---|---|
| KR | 10-2003-0092871 A | | 12/2003 | |
| KR | 10-2005-0051993 A | | 6/2005 | |
| WO | WO03102481 | * | 5/2003 | F25D 23/12 |
| WO | WO2004092664 | * | 3/2004 | B60H 1/32 |

* cited by examiner

*Primary Examiner* — Tony G Soohoo
*Assistant Examiner* — Peter Keyworth
(74) *Attorney, Agent, or Firm* — Birch, Stewart, Kolasch & Birch, LLP

(57) ABSTRACT

A water-filter mounting structure for a refrigerator has a filter receiving section provided below a dispenser that is mounted at a door for selectively opening and closing a storage space and discharges water or ice to the outside. A water filter mounted in the filter receiving section purifies water supplied from a water supplying source. It is possible to minimize reduction in a storage capacity, loss in cold air and damage to the water filter and improve product compatibility.

3 Claims, 7 Drawing Sheets

WATER-FILTER MOUNTING STRUCTURE FOR REFRIGERATOR

TECHNICAL FIELD

The present invention relates to a refrigerator, and more particularly, to a water-filter mounting structure for a refrigerator, which enables a water filter to purify water discharged to the outside through a dispenser in the refrigerator.

BACKGROUND ART

FIG. 7 is a front perspective view showing the interior of a refrigerator provided with a conventional water-filter mounting structure for a refrigerator.

As shown in the figure, a storage space for storing foods therein is provided within a refrigerator main body 2. The storage space includes a freezing chamber 4 and a refrigerating chamber 4', which are obtained through lateral division by a partition 6.

A water filter 8 for purifying water discharged to the outside through a dispenser 12, which will be described below, is provided at an upper side of the refrigerating chamber 4'. One end of a water supplying pipe (not shown) penetrating one sidewall of the refrigerating chamber 4' is connected to the water filter 8.

Meanwhile, the freezing chamber 4 and the refrigerating chamber 4' are selectively opened or closed by a freezing chamber door 10 and a refrigerating chamber door 10', respectively. The freezing chamber door 10 and the refrigerating chamber door 10' are installed at both sides of the main body 2 such that one end of each of the chamber doors can be pivoted forward and rearward on the other end thereof.

Further, the dispenser 12 is provided in the freezing chamber door 10. The dispenser 12 is provided to allow a user to obtain water and/or ice from the outside without opening the freezing chamber door 10. To this end, ice that has been made in an ice maker (not shown) provided in the refrigerating chamber 4 and/or water purified by the water filter 8 are/is supplied to the dispenser 12.

However, the refrigerator provided with the conventional water-filter mounting structure as described above has the following disadvantages.

As described above, the water filter 8 is installed within the refrigerating chamber 4. Accordingly, there is a disadvantage in that a space in which foods can be stored, i.e., a storage capacity, is relatively reduced due to the water filter 8.

In addition, in order to replace the water filter 8 with a new one, the refrigerating chamber door 10' should be opened to open the refrigerating chamber 4'. Accordingly, there is a possibility that cold air in the refrigerating chamber 4' will leak to the outside in the process of replacing the water filter 8.

Moreover, the refrigerating chamber 4' is maintained at a relatively low temperature to maintain freshness of foods. Thus, there is a risk that the water filter 8 may be easily damaged due to the low temperature in the refrigerating chamber 4'.

Furthermore, the water supplying pipe passes through the main body 2 and is then connected to the water filter 8. However, the water filter 8 or the dispenser 12 is selectively provided according to the kind of a refrigerator. Accordingly, since the specification of the main body 2 depends on whether the water filter 8 or the dispenser 12 is provided, there is a disadvantage in that product compatibility is lowered.

DISCLOSURE OF INVENTION

Technical Problem

The present invention is conceived to solve the aforementioned problems. An object of the present invention is to provide a water-filter mounting structure for a refrigerator, which is constructed to minimize reduction in a storage capacity.

Another object of the present invention is to provide a water-filter mounting structure for a refrigerator, which is constructed to minimize loss in cold air during replacement of a water filter.

A further object of the present invention is to provide a water-filter mounting structure for a refrigerator, which is constructed to minimize damage to a water filter.

A still further object of the present invention is to provide a water-filter mounting structure for a refrigerator, which is constructed to improve product compatibility.

Technical Solution

According to an aspect of the present invention for achieving these objects, there is a provided water-filter mounting structure for a refrigerator, comprising: a filter receiving section provided below a dispenser for discharging water or ice to the outside, the dispenser being mounted at a door for selectively opening and closing a storage space; and a water filter mounted in the filter receiving section to purify water supplied from a water supplying source.

The filter receiving section may be formed to vertically communicate with the interior of the filter receiving section, and the water-filter mounting structure may further comprise a cover plate for selectively opening and closing the filter receiving section and substantially defining a bottom surface of the dispenser.

The cover plate may have a periphery of a bottom surface supported by an upper end of a supporting rib provided at a periphery of the filter receiving section in a state where the cover plate shields the filter receiving section An operation for downwardly pressing one side edge of the cover plate corresponding to a cutout section formed by cutting a portion of the supporting rib may cause another side edge of the cover plate spaced apart from the cutout section to be upwardly pivoted away from the supporting rib.

Further there is comprised a sealing member for hermetically sealing the filter receiving section.

Meanwhile, the present invention provides, a water-filter mounting structure for a refrigerator, comprising: a filter case provided below a dispenser for discharging water or ice to the outside, the dispenser being mounted at a door for selectively opening and closing a storage space; and a water filter mounted in the filter case to purify water supplied from a water supplying source.

Further there is comprised a cover plate for selectively opening and closing the filter case and substantially defining a bottom surface of a recess provided in the dispenser.

The cover plate may be have a periphery of a bottom surface supported by an upper end of a supporting rib provided at a periphery of the filter case in a state where the cover plate shields the filter case.

An operation for downwardly pressing one side edge of the cover plate corresponding to a cutout section formed by cutting a portion of the supporting rib may cause another side edge of the cover plate spaced apart from the cutout section to be upwardly pivoted away from the supporting rib.

Further there is comprised a sealing member for hermetically sealing the filter case.

Meanwhile, the present invention provides water-filter mounting structure for a refrigerator, comprising: a filter receiving section provided at an upper portion of a door for selectively opening and closing a storage space; and a water filter mounted in the filter receiving section to purify water to be supplied to a dispenser, the dispenser being provided in a front face of the door to discharge water or ice to the outside.

The filter receiving section may be provided in a deco cap defining an appearance of an upper face of the door.

A first water supplying pipe for supplying water from a water supplying source to the water filter and a second water supplying pipe for supplying water purified by the water filter to a water tank or an ice maker may penetrate through-holes formed at a side of the filter receiving section and are then connected to the water filter.

Further there is comprised a cover plate for selectively opening and closing the filter receiving section.

The cover plate selectively may open and close a hinge mounting section in which a hinge assembly for pivotably supporting the door on a refrigerator main body is mounted.

Meanwhile, the present invention provides a refrigerator comprising the water-filter mounting structure for a refrigerator according to any one of claims 1 to 15.

According to the present invention described above, there are advantages in that it is possible to minimize reduction in a storage capacity, loss in cold air and damage to a water filter and to improve product compatibility.

Advantageous Effects

According to the water-filter mounting structure for a refrigerator according to the present invention described above, it is expected to obtain the following effects.

First, since a water filter is provided in a refrigerator door, i.e., on the bottom of a dispenser or at an upper portion of the door in the present invention, it is possible to minimize reduction in a storage capacity of a refrigerator due to the water filter. Thus, the refrigerator can be utilized more efficiently.

Moreover, since the water filter can be replaced with a new one without opening the door in the present invention, cold air in a storage space does not leak to the outside during the replacement of the water filter. Thus, the refrigerator can be utilized in a more economical manner.

In addition, since the water filter is provided at the door, i.e., outside the storage space, in accordance with the present invention, it is possible to prevent a phenomenon in which the water filter may be damaged by the cold air circulating in the storage space. Thus, the durability of the product can be enhanced.

Furthermore, since the water filter is provided in the door in accordance with the present invention, a connection pipe for supplying water to the dispenser can be connected to the water filter without penetrating through a refrigerator main body. Accordingly, regardless of the presence of the water filter or dispenser, refrigerator main bodies with an identical specification can be used, thereby enhancing product compatibility and reducing production costs.

BEST MODE

Hereinafter, preferred embodiments of a water-filter mounting structure for a refrigerator according to the present invention will be described in greater detail with reference to accompanying drawings.

Figure 1:
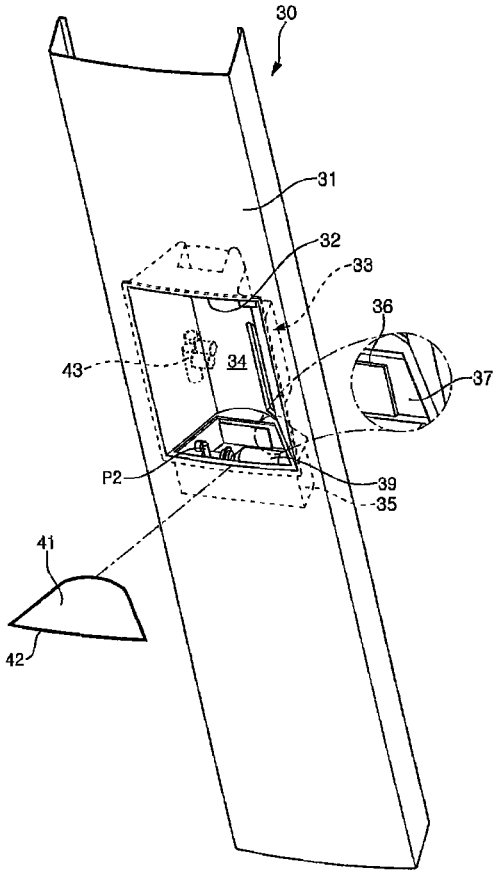
FIG. 1 is an exploded perspective view schematically showing a front face of a refrigerator door provided with a first embodiment of a water-filter mounting structure for a refrigerator according to the present invention.
Figure 2:
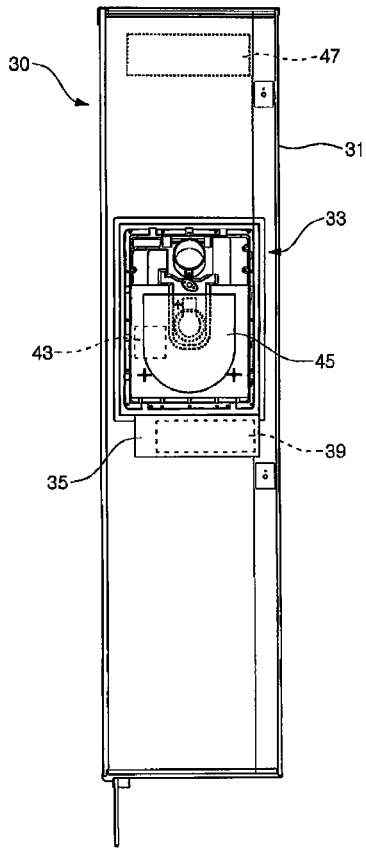
FIG. 2 is rear view showing a rear face of the refrigerator door provided with the first embodiment.
Figure 3:
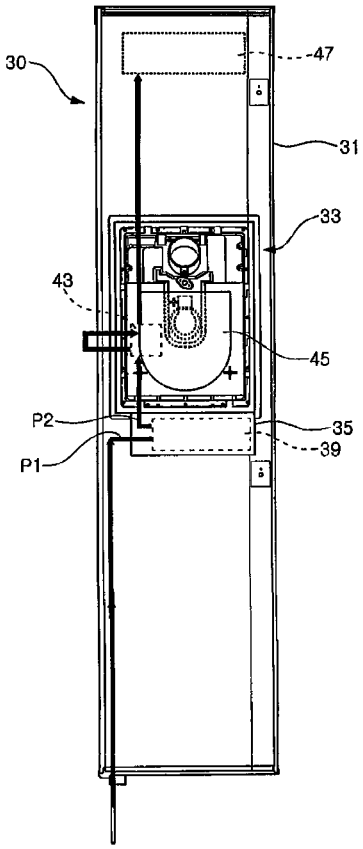
FIG. 3 is a view showing a flow path of water in the refrigerator door provided with the first embodiment.

FIG. 1 is an exploded perspective view schematically showing a front face of a refrigerator door provided with a first embodiment of a water-filter mounting structure for a refrigerator according to the present invention, FIG. 2 is rear view showing a rear face of the refrigerator door provided with the first embodiment, and FIG. 3 is a view showing a flow path of water in the refrigerator door provided with the first embodiment.

As shown in these figures, an outer door 31 defines appearances of a front face and both side faces of a refrigerator door 30. A substantially rectangular opening 32 is provided at a side of the outer door 31 defining the appearance of the front face of the refrigerator door 30. A dispenser 33 is provided on a rear face of the outer door 31 in correspondence with a periphery of the opening 32.

The dispenser 33 is provided to obtain water or ice from the outside without opening the door 30. The dispenser 33 is provided with a recess 34 formed by inwardly depressing the door 30. The recess 34 substantially serves as a space in which ice or water is discharged and has a polyhedral shape with open front and bottom faces.

Meanwhile, a filter case 35 is provided below the recess 34. The filter case 35 has a polyhedral shape with a cross section corresponding to that of the recess 34. The filter case 35 has an open upper face through which it communicates with the recess 34.

Although the recess 34 and the filter case 35 are formed to have a hexahedral shape with a trapezoid cross section in the embodiment shown in the figures, the present invention is not limited thereto. Further, the filter case 35 may be formed integrally with the dispenser 33 or may be formed separately from and then fixed to the dispenser 33.

A supporting rib 36 is provided at an inner periphery of the filter case 35. The supporting rib 36 is formed to be downwardly stepped relative to an upper end of the filter case 35 by a height corresponding to the thickness of a cover plate 41 to be described below. A cutout section 37 is formed at a side of the supporting rib 36. The supporting rib 36 is formed by cutting a portion of the supporting rib 36 corresponding to an inner edge of the filter case 35. In addition, a water filter 39 is installed within the filter case 35. The water filter 39 is provided to purify water supplied from a water supplying source and to supply the purified water to a water tank 45 and an ice maker 47, which will be described below.

As shown in detail in FIG. 3, a first water supplying pipe P1 and a second water supplying pipe P2 are connected to the water filter 39. The first water supplying pipe P1 is provided to supply water from the external water supplying source to the water filter 39. The second water supplying pipe P2 is utilized to supply the water purified by the water filter 39 to a valve 43 that will be described below.

In addition, the cover plate 41 is provided to selectively open or close the open upper face of the filter case 35. The cover plate 41 has a plate shape corresponding to the cross section of the filter case 35. The cover plate 41 substantially serves as a bottom surface of the recess 34 while shielding the filter case 35. Further, a periphery of a bottom surface of the cover plate 41 is supported by an upper surface of the supporting rib 36 so that the cover plate is not fully inserted into the filter case 35.

A sealing member 42 is provided at a periphery of the cover plate 41. The sealing member 42 is provided between an upper side of the inner periphery of the filter case 35 and the periphery of the cover plate 41 to hermetically seal the filter case 35. That is, the sealing member 42 is provided to prevent foreign substances such as water or dust from being introduced into the filter case 35.

Meanwhile, the valve 43 is provided at a side of the dispenser 33. The valve 43 is to selectively supply the water purified by the water filter 39 to the water tank 45 and the ice maker 47.

In addition, the water tank 45 is provided on a rear surface of the dispenser 33, as shown in FIG. 2. The water tank 45 stores water that has been purified by the water filter 39 and is to be discharged to the outside through the dispenser 33.

As shown in FIG. 3, the ice maker 47 is provided at an upper portion on a rear surface of the door 30. The ice maker 47 makes ice using water that has been purified by the water filter 39 and supplied via the valve 43.

Hereinafter, the operation of the first embodiment of the water-filter mounting structure for a refrigerator according to the present invention will be described in detail.

A process of replacing the water filter in the first embodiment of the water-filter mounting structure for a refrigerator according to the present invention will be explained.

First, the filter case 35 shielded by the cover plate 41 is opened. To this end, one side edge of the cover plate 41 corresponding to the cutout section 37 is pressed downward. However, since the other portions of the cover plate 41 are supported by the upper surface of the supporting rib 36, another side edge of the cover plate 41 spaced apart from the cutout section 37 is upwardly pivoted away from the supporting rib 36 on the one side edge of the cover plate corresponding to the cutout section 37. Then, a user grasps the other side edge of the cover plate 41 pivoted away from the supporting rib 36 and then separates the cover plate 41.

On the other hand, when the filter case 35 is opened, the water filter 39 mounted within the filter case 35 is separated and a new water filter is then mounted therein. When the replacement of the water filter 39 is completed as described above, the open upper face of the filter case 35 is shielded by the cover plate 41.

Next, the flow of water in the refrigerator door provided with the first embodiment of the water-filter mounting structure for a refrigerator according to the present invention will be described with reference to FIG. 3.

First, water delivered from the water supplying source is supplied to the water filter 39 through the first water supplying pipe P1. Then, the water is purified while passing through the water filter 39, and the purified water is stored in the water tank 45 or supplied to the ice maker 47 through the second water supplying pipe P2. At this time, the flow of the water that is to be stored in the water tank 45 or supplied to the ice maker 47 is controlled by opening closing the valve 43.

The water supplied to the water tank 45 is discharged to the outside through the dispenser 33 by an operation of a user. Otherwise, the water supplied to the ice maker 47 is made into ice and ice is then discharged to the outside through the dispenser 33 by an operation of the user.

MODE FOR INVENTION

Hereinafter, another embodiment of the water-filter mounting structure for a refrigerator according to the present invention will be described in greater detail with reference to accompanying drawings.

Figure 4:
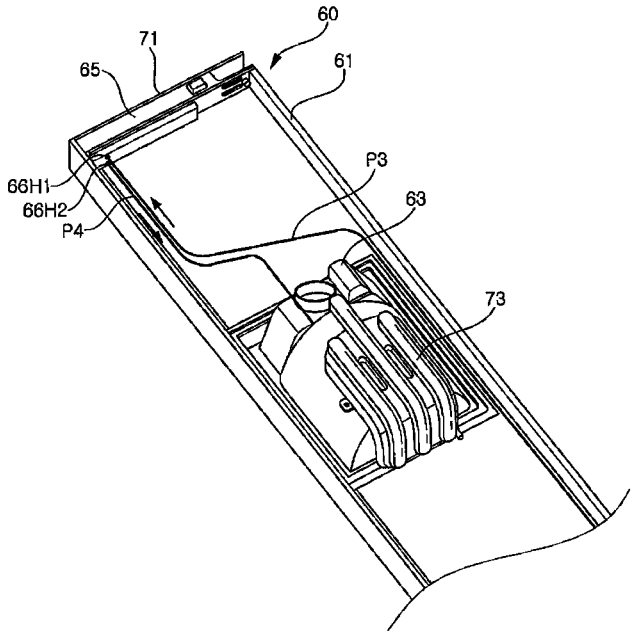
FIG. 4 is a perspective view schematically showing the interior of a refrigerator door provided with a second embodiment of the water-filter mounting structure for a refrigerator according to the present invention.
Figure 5:
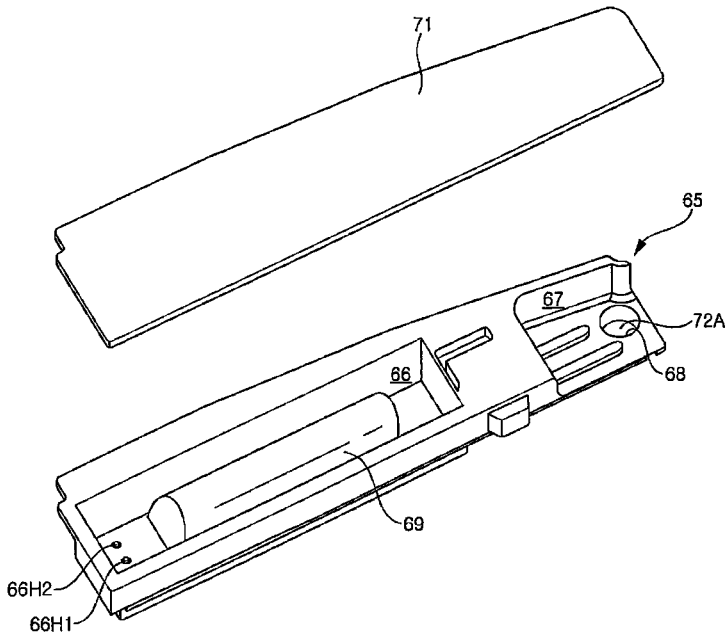
FIG. 5 is an exploded perspective view showing a deco cap and a shielding member in the second embodiment.
Figure 6:
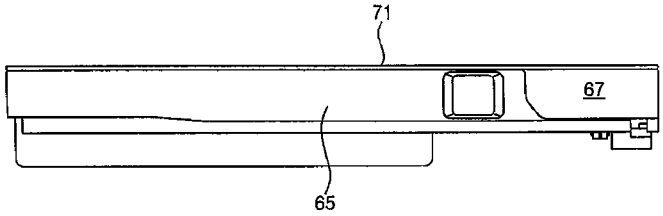
FIG. 6 is a side view showing the deco cap in the second embodiment.

FIG. 4 is a perspective view schematically showing the interior of a refrigerator door provided with a second embodiment of the water-filter mounting structure for a refrigerator according to the present invention, FIG. 5 is an exploded perspective view showing a deco cap and a shielding member in the second embodiment, and FIG. 6 is a side view showing the deco cap in the second embodiment.

As shown in the figures, an outer door 61 defines appearances of a front face and both side faces of a refrigerator door 60. A rectangular opening (not shown) is provided at a side of the outer door 61 defining the appearance of the front face of the refrigerator door 60. A dispenser 63 is provided on a rear face of the outer door 61 in correspondence with a periphery of the opening. The dispenser 63 is provided to discharge water or ice.

Further, a deco cap 65 defines an appearance of an upper face of the door 60. The deco cap 65 is coupled to an upper end of the outer door 61. Although not shown in the figures, another deco cap defines an appearance of a lower face of the door 60. Since the deco cap defining the appearance of the lower face of the door 60 is not related to technical features of the present invention, however, a description thereof will be omitted.

A filter receiving section 66 is provided at a side of the deco cap 65 as shown in detail in FIG. 5. The filter receiving section 66 has a substantially hexahedral shape with an open upper side. A pair of through-holes 66H1 and 66H2 are formed at a side of a bottom surface of the filter receiving section 66.

Figure 7:
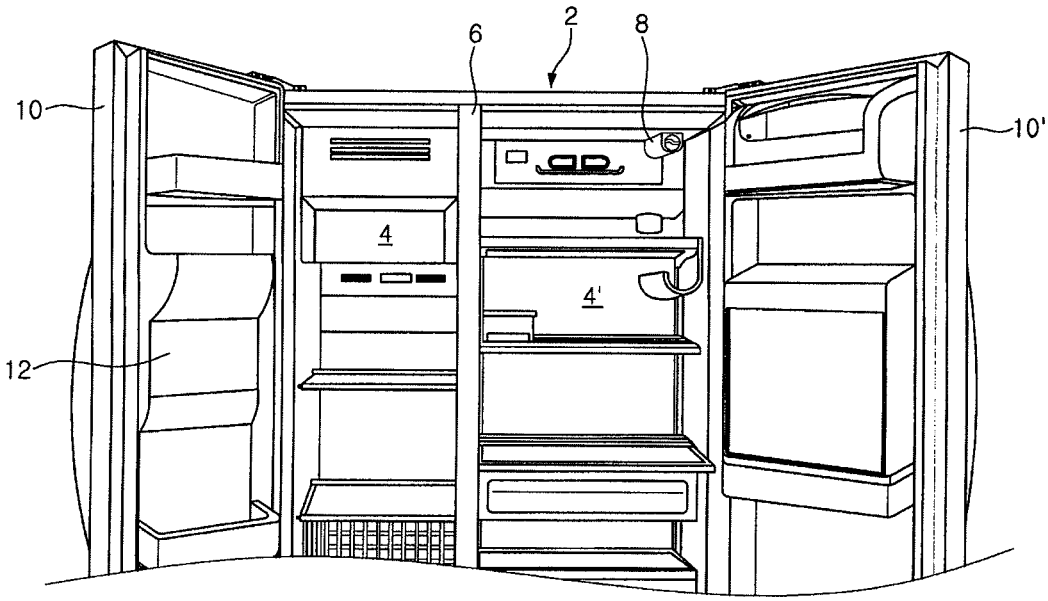
Figure 7 Conventional Art
FIG. 7 is a front perspective view showing the interior of a refrigerator provided with a conventional water-filter mounting structure for a refrigerator.

In addition, a hinge mounting section 67 is provided at a side of the deco cap 65. And, a hinge inserting hole 68 is formed in a bottom surface of the hinge mounting section 67. A hinge assembly (not shown) for pivotably supporting the door 60 on the refrigerator main body 2 (see FIG. 7) is installed in the hinge mounting section 67. A hinge pin (not shown) provided in the hinge assembly passes through the hinge inserting hole 68.

Meanwhile, a water filter 69 is mounted within the filter receiving section 69. First and second water supplying pipes P3 and P4 pass through the through-holes 66H1 and 66H2 and are then connected to one side of the water filter 69. The first water supplying pipe P3 is provided to supply water from an external water supplying source to the water filter 69. Both ends of the first water supplying pipe P3 are connected to the water supplying source and the water filter 69, respectively. The second water supplying pipe P4 is utilized to supply water purified by the water filter 69 to a water tank 73 or an ice maker (not shown) that will be described below. To this end, one end of the second water supplying pipe P4 is connected to the water filter 69, and the other end of the second water supplying pipe P4 is connected to a valve (not shown) that is opened and closed to selectively supply water purified by the water filter 69 to the water tank 73 and the ice maker.

A cover plate 71 is provided to selectively open and close the filter receiving section 66 and the hinge mounting section 67. The cover plate 71 is formed to have a plate shape corresponding to a cross section of the deco cap 65. Although the cover plate 71 is formed to selectively open and close both the filter receiving section 66 and the hinge mounting section 67 in the embodiment shown in the figures, the present invention is not limited thereto. The cover plate 71 may be formed to selectively open and close only the filter receiving section 66.

Meanwhile, the water tank 73 is provided on a rear surface of the dispenser 63. Water purified by the water filter 69 is stored in the water tank 73. Although the water tank 73 is formed to have an approximately "L"-shaped cross section for surrounding the dispenser 63 in the embodiment shown in the figures, the present invention is not limited thereto.

Now, the operation of the second embodiment of the water-filter mounting structure for a refrigerator according to the present invention will be described in detail.

A process of replacing the water filter in the second embodiment of the water-filter mounting structure for a refrigerator according to the present invention will be described.

First the cover plate 71 is separated from the deco cap 65 to open the filter receiving section 66. In the state where the filter receiving section 66 is opened as such, the water filter 69 mounted in the filter receiving section 66 is separated and removed, and a new water filter is then mounted therein. Then, the filter receiving section 66 is shielded by the cover plate 71 to complete the replacement of the water filter 69.

Next, the flow of water in the refrigerator door provided with the second embodiment of the water-filter mounting structure for a refrigerator according to the present invention will be described with reference to FIG. 4.

First, water in the water supplying source is supplied to the water filter 69 through the first water supplying pipe P3, and the water is purified while passing through the water filter 69. The water purified by the water filter 69 is stored in the water tank 73 or supplied to the ice maker through the second water supplying pipe P4 by opening or closing the valve.

The water supplied to the water tank 73 is discharged to the outside through the dispenser 63 by an operation of a user. Otherwise, the water supplied to the ice maker is made into ice and ice is then discharged to the outside through the dispenser 63 by an operation of the user.

The scope of the present invention is not limited to the embodiments described above but defined by the appended claims. It will be apparent that those skilled in the art can make various modifications and adaptations thereto within the scope of the present invention defined by the appended claims.

The invention claimed is:

1. A water-filter mounting structure, comprising:

a refrigerator door having a front panel, the front panel having a front surface and a rear surface;

a top wall extending from a top of the front panel;

a first recess formed in the top wall for receiving a water filter;

a water filter in the first recess;

a cover over the first recess;

a pair of through holes in the first recess allowing passage of a water supply line;

a second recess in the top wall;

a hinge inserting hole in the second recess; and a dispenser formed in the front surface of the front panel, the water supply line extending to the dispenser.

2. The water-filter mounting structure of claim 1, wherein the water supply line extends along the rear surface of the front panel.

3. The water-filter mounting structure as claimed in claim 1, further comprising a water tank, on the rear surface of the front panel, wherein the water supply line extends from the water tank, to the first recess and to the dispenser.

* * * * *